US006039615A

United States Patent [19]

Suzuki

[11] Patent Number: 6,039,615

[45] Date of Patent: Mar. 21, 2000

[54] FEMALE ELECTRICAL TERMINAL HAVING OVERSTRESS MEMBERS

[75] Inventor: Mitsuru Suzuki, Kanagawa, Japan

[73] Assignee: The Whitaker Corporation, Wimington, Del.

[21] Appl. No.: 09/125,951

[22] PCT Filed: Mar. 13, 1997

[86] PCT No.: PCT/US97/04002

§ 371 Date: Aug. 26, 1998

§ 102(e) Date: Aug. 26, 1998

[87] PCT Pub. No.: WO97/34341

PCT Pub. Date: Sep. 18, 1997

[30] Foreign Application Priority Data

Mar. 15, 1996 [JP] Japan ..... 8-059068

[51] Int. Cl.[7] ..... H01R 11/22

[52] U.S. Cl. ..... 439/849; 439/850

[58] Field of Search ..... 439/849, 850, 439/852, 268

[56] References Cited

U.S. PATENT DOCUMENTS

| | | | |
|---|---|---|---|
| 3,729,701 | 4/1973 | Smith | 439/850 |
| 3,976,348 | 8/1976 | Simmons | 339/74 R |
| 4,415,221 | 11/1983 | Inoue et al. | 339/258 F |
| 4,699,444 | 10/1987 | Isohata | 439/839 |
| 4,934,966 | 6/1990 | D'Urso | 439/849 |
| 5,350,321 | 9/1994 | Takenouchi | 439/839 |

FOREIGN PATENT DOCUMENTS

| | | | |
|---|---|---|---|
| 1-132072 | of 1989 | Japan | H01R 13/115 |
| 6-7580 | 2/1994 | Japan | H01R 13/115 |
| 2 291 284 A | 1/1996 | United Kingdom | H01R 13/187 |

OTHER PUBLICATIONS

PCT International Application, International Publication Number: WO 88/05611, International Publication Date: Jul. 28, 1988, International Application Number: PCT/US87/03215.

*Primary Examiner*—Renee S. Luebke
*Assistant Examiner*—Javaid Nasri

[57] ABSTRACT

The female terminal of the present invention is equipped with a bottom plate (11) which extends in the forward-rearward direction, side plates (12*a*, 12*b*) which rise vertically from both side edges of the bottom plates (11), two upper contact parts (14*a*, 14*b*) which are formed by bending the respective free ends of the side plates (12*a*, 12*b*) inward so that the free ends face the bottom plate (11), and a lower contact part (15) which extends rearward from the vicinity of the front end portion (11*c*) of the bottom plate (11) on the side where a mating tab terminal is inserted, and which has a projection (16) on its upper surface. A mating tab terminal is inserted so that a home in the tab terminal engages with the projection (16), the female terminal is further equipped with arm parts (20*a*, 20*b*) which rise vertically from both side edges of the bottom plate (11) and part of the side plates (12*a*, 12*b*), with the free ends (21*a*, 21*b*) of the arm parts being bent back over the upper contact parts (14*a*, 14*b*).

6 Claims, 4 Drawing Sheets

FEMALE ELECTRICAL TERMINAL HAVING OVERSTRESS MEMBERS

FIELD OF THE INVENTION

The present invention concerns a female terminal in which electrical contact with a mating tab terminal is accomplished by inserting said tab terminal.

BACKGROUND OF THE INVENTION

Conventionally, female terminals such as the terminal disclosed in, for example, Japanese Utility Model Application No. 1-132072 have been widely used as female terminals of this type.

FIG. 14 is a schematic diagram of the above mentioned conventional female terminal.

As is shown in FIG. 14, this female terminal 10 is equipped with a bottom plate 1, side plates 2*a* and 2*b* which rise vertically from both side edges 1*a* and 1*b* of the bottom plate 1, two upper contact parts 4*a* and 4*b* which are formed by bending the respective free ends 3*a* and 3*b* of the side plates 2*a* and 2*b* inward so that these free ends face the bottom plate 1, and a lower contact part 5 which extends rearward from the vicinity of the front end portion 1*c* of the bottom plate 1 on the side where a mating tab terminal 9 is inserted, and which has a projection 6 formed on its upper surface. Furthermore, the rear end portion of the lower contact part 5 extends rearward and is bent upward so that a pressing part 5*a* is formed, and a portion of the bottom plate 1 extends rearward and forms a barrel 7 which is used for the connection of wires. When a mating tab terminal 9 which has a hole 9*a* formed in a position corresponding to the projection 6 of the lower contact part 5 is inserted between the upper contact parts 4*a* and 4*b* and lower contact part 5 of the female terminal 10 constructed as described above, the hole 9*a* in the tab terminal 9 and the projection 6 on the female terminal 10 engage so that the female terminal 10 and tab terminal 9 are connected. When the tab terminal 9 is to be removed from the female terminal 10, the engagement of the projection 6 and hole 9*a* is released by pressing the pressing part 5*a* downward so that the lower contact part 5 is caused to bend downward with a point in the vicinity of the front end portion 1*c* of the bottom plate 1 acting as a supporting point.

However, in the female terminal 10 described above, the upper contact parts 4*a* and 4*b* have a cantilever beam structure. As a result, the following problem arises: i. e., if an unreasonable amount of force is applied to the upper contact parts 4*a* and 4*b* as a result of the tab terminal 9 being inserted from an incorrect insertion direction when the tab terminal 9 is inserted between the upper contact parts 4*a* and 4*b* and the lower contact part 5, the upper contact parts 4*a* and 4*b* are easily deformed.

Furthermore, since the pressing part 5*a* in the female terminal 10 described above is formed by extending the rear end portion of the lower contact part 5 in the rearward direction, the overall female terminal must have a length equal to the total of the length of the lower contact part 5 and the length of the pressing part 5*a*. Accordingly, this creates a restriction in terms of reducing the overall size of the female terminal 10.

SUMMARY OF THE INVENTION

In light of the above facts, the object of the present invention is to provide a compact female terminal which makes it possible to prevent deformation of the female terminal when a tab terminal is inserted.

The invention is directed to a female terminal having a base plate, side portions extending upwardy from the base plate, upper contact parts formed at ends of the side plates, a lower contact part extending rearwardly from a forward part of the base portion and having a projection thereon for engaging a mating tab terminal with a hole for engagement with the projection. Arm parts extend upwardly from the base plate and free ends of the arm parts are bent over the upper contact parts. The free ends are above the upper contact parts thereby providing overstress protection to the upper contact parts.

The invention is further directed to a female terminal having a bottom plate, side plates which extend upwardly from the bottom plate, two upper contact parts formed on ends of the side plates, a lower contact part which extends rearwardly from a forward part of the bottom plate and having a projection thereon for engaging a mating tab terminal with a hole for engagement with the projection. A pressing part extends from the lower contact part. The pressing part has an L-shaped cut that extends between an intermediate portion of one side edge of the lower contact part and the rear end portion of the lower contact part is cut and raised upward with the rear end portion of the lower contact part acting as a supporting point, and releases the engagement between the lower contact part and the tab terminal by being pressed downward so that the lower contact part is caused to bend downward with a point in the vicinity of the front end portion of the bottom plate acting as a supporting point.

BRIEF DESCRIPTION OF THE DRAWINGS

Embodiments of the present invention will now be described by way of example with reference to the accompanying drawings, in which:

FIG. 1 is a schematic diagram which illustrates a first embodiment of the female terminal of the present invention.

DETAILED DESCRIPTION OF THE INVENTION

Figure 1:
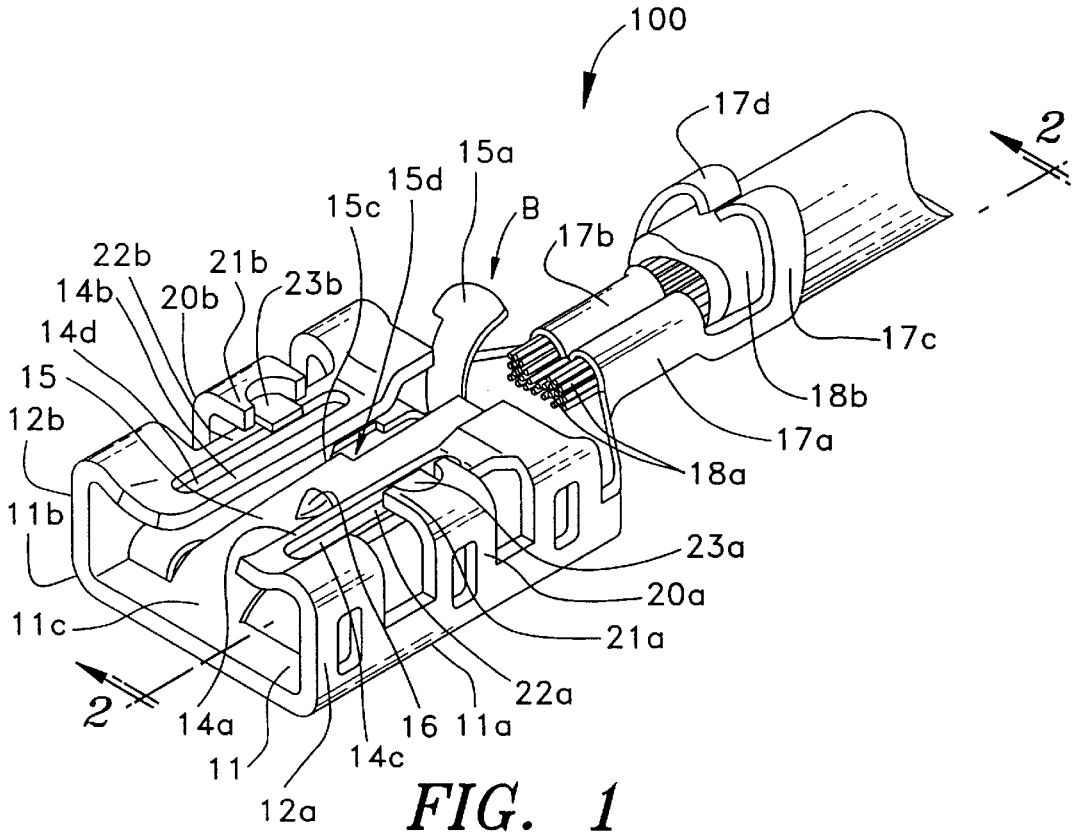
FIG. 1 is an isometric view of a first embodiment of the female terminal of the present invention.
Figure 2:
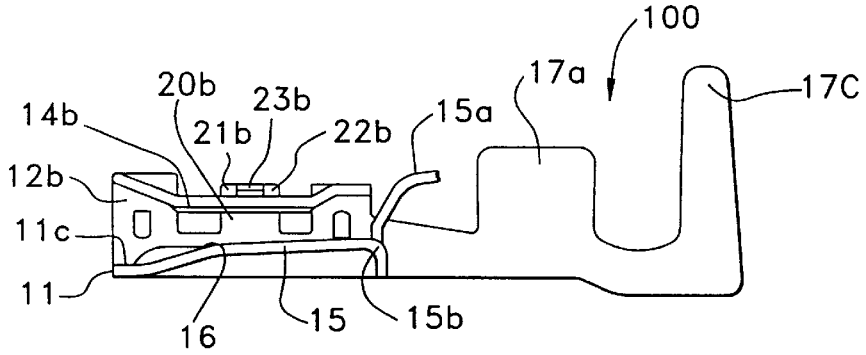
FIG. 2 is a partial sectional view along line 2—2 in FIG. 1.

As is shown in FIGS. 1 and 2, this female terminal 100 is equipped with a bottom plate 11 which extends in the forward-rearward direction, side plates 12*a* and 12*b* which rise vertically from both side edges 11*a* and 11*b* of the bottom plate 11, two upper contact parts 14*a* and 14*b* which are formed by bending the respective free ends of the side plates 12*a* and 12*b* inward so that these free ends face the bottom plate 11, and a lower contact part 15 which extends rearward from the vicinity of the front end portion 11*c* of the bottom plate 11 on the side where a mating tab terminal is inserted, and which has a projection 16 formed on its upper surface. Beads 14*c* and 14*d* which protrude downward are respectively formed on the upper contact parts 14*a* and 14*b*, and the mating tab terminal which is inserted between the upper contact parts 14*a* and 14*b* and lower contact part 15 of the female terminal 100 makes electrical contact with these beads 14*c* and 14*d* and the lower contact part 15. A hole or recess is formed in the mating tab terminal in a position corresponding to the projection 16 of the lower contact part 15, and this hole or recess engages with the projection 16 so that the female terminal 100 and mating tab terminal are connected. Furthermore, a portion of the bottom plate 11 extends rearward and forms conductor barrels 17*a* and 17*b* which are used for the connection of wires 18*a*, and insulation barrels 17*c* and 17*d* which are used to fasten the insulating material 18*b* of the wires in place.

Furthermore, the female terminal 100 is equipped with arm parts 20*a* and 20*b* which rise vertically from both side edges 11*a* and 11*b* of the bottom plate 11 and separate from the side plates 12*a* and 12*b*. The free ends 21*a* and 21*b* of the arm parts 20*a* and 20*b* are bent back over the upper contact parts 14*a* and 14*b* in positions 22*a* and 22*b* which are located above the upper contact parts 14*a* and 14*b* and which are separated from the upper contact parts 14*a* and 14*b*. Furthermore, protruding portions 23*a* and 23*b* which are caused to protrude forward are formed in portions of the free ends 21*a* and 21*b* by pressing portions of the free ends 21*a* and 21*b*.

Since the female terminal 100 is constructed as described above, even if an unreasonable force is applied to the upper contact parts 14*a* and 14*b* as a result of insertion of the mating tab terminal from an incorrect direction when the tab terminal is inserted between the upper contact parts 14*a* and 14*b* and lower contact part 15, the free ends 21*a* and 21*b* and protruding portions 23*a* and 23*b* of the arm parts 20*a* and 20*b* inhibit any deformation of the upper contact parts 14*a* and 14*b*, so that deformation of the upper contact parts 14*a* and 14*b* is prevented. This function of the arm parts 20*a* and 20*b* will be referred to below as an "anti-overstress function".

Furthermore, the rear end portion 15*b* of the lower contact part 15 of the female terminal 100 of this embodiment has a pressing part 15*a* which is formed by a process in which a portion of the lower contact part surrounded by an L-shaped cut 15*d* that extends between an intermediate portion of one side edge 15*c* of the lower contact part 15 and the rear end portion 15*b* of the lower contact part is cut and raised upward with the rear end portion 15*b* of the lower contact part 15 being caused to act as a supporting point.

Figure 3:
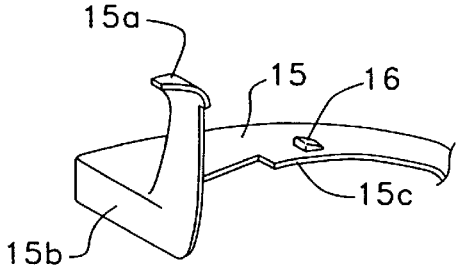
FIG. 3 is an enlargement illustrating the pressing part in the female terminal shown in FIGS. 1 and 2.

FIG. 3 is a partial enlargement of the pressing part 15*a* in the female terminal 100 shown in FIGS. 1 and 2. Furthermore, in order to illustrate the manner in which a portion of the lower contact part 15 is cut and raised upward with the rear end portion 15*b* being caused to act as a supporting point, FIG. 3 is shown as a perspective view from the direction indicated by arrow B in FIG. 1.

When this pressing part 15*a* is pressed downward, the lower contact part 15 is caused to bend downward with a point in the vicinity of the front end portion 11*c* of the bottom plate 11 acting as a supporting point, so that the engagement of the lower contact part 15 and the mating tab terminal is released.

Next, the method used to manufacture this female terminal 100 will be described.

Figure 4:
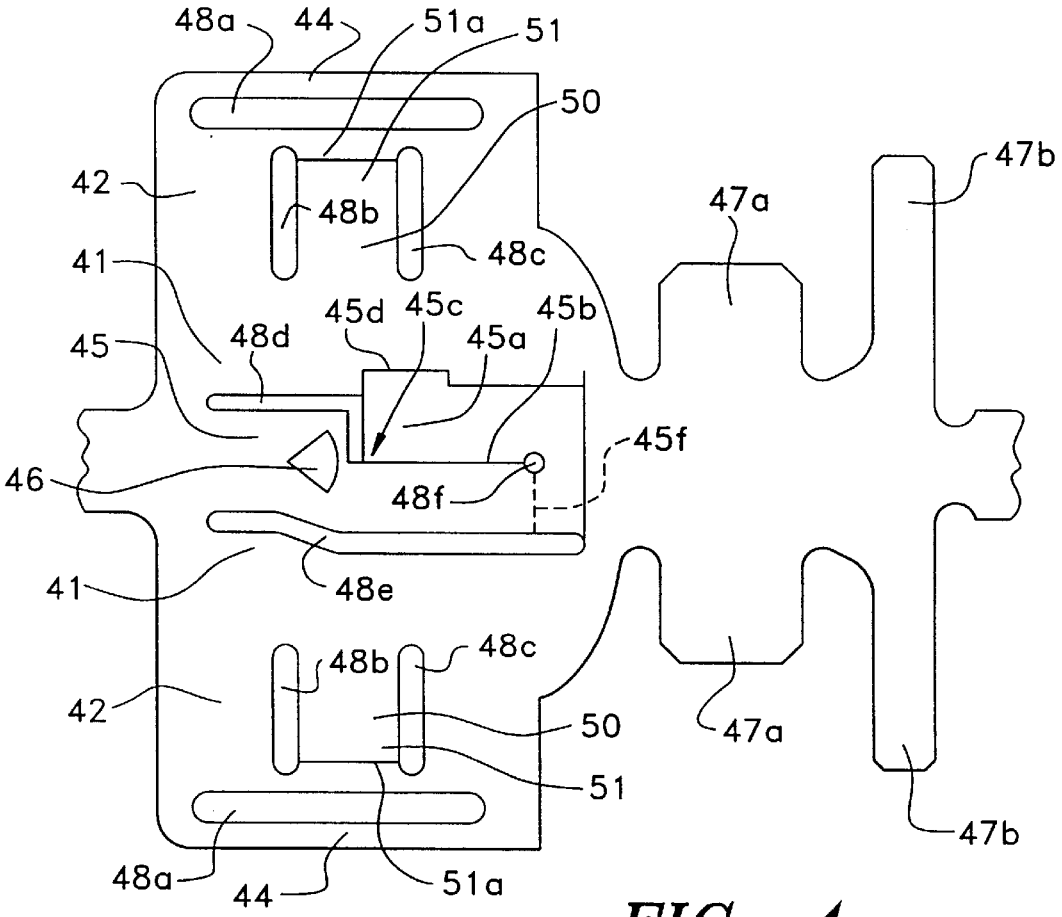
FIG. 4 shows the sheet metal punch-out pattern used in the manufacture of the female terminal of the first embodiment.

FIG. 4 is a diagram which illustrates the sheet metal punch-out pattern used in the manufacture of the female terminal 100 of the first embodiment.

As is shown in FIG. 4, a bottom plate portion 41, side plate portions 42, upper contact part portions 44, projection portion 46, pressing part portion 45*a*, arm part portions 50, arm part free end portions 51, conductor barrel portions 47*a* and insulation barrel portions 47*b* which are used to form the female terminal are punched out of a metal sheet in a single integrated shape.

The arm part portions 50 are separated from the side plate portions 42 and upper contact part portions 44 by slits 51*a* formed at the tip ends of the arm part free end portions 51 and punched-out portions 48*b* and 48*c* which connect with these slits 51*a*.

The lower contact part portion 45 and pressing part portion 45*a* are separated from the bottom plate portion 41 by a punched-out portion 48*d*, a slit 45*d* and a punched-out portion 48*e*; furthermore, the pressing part portion 45*a* is formed into the shape shown in FIG. 3 by a process in which an L-shaped cut portion 45*c* formed by the punched-out portion 48*d* and a slit 45*b* is pulled upward with the broken line 45*f* shown in the vicinity of the punched-out portion 48*f* used as a supporting point. Moreover, bead portions 48*a* which protrude downward and form the actual contact surfaces with the mating tab terminal are formed in the upper contact part portions 44.

Figure 5:
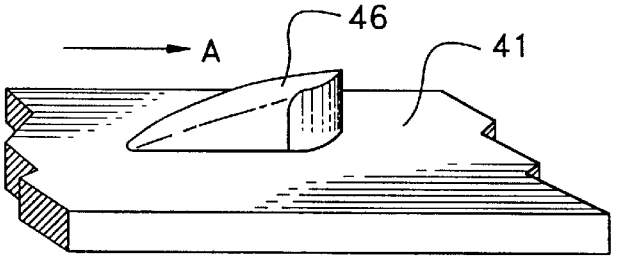
FIG. 5 is a partial detailed view of the projection portion shown in FIG. 4.
Figure 14:
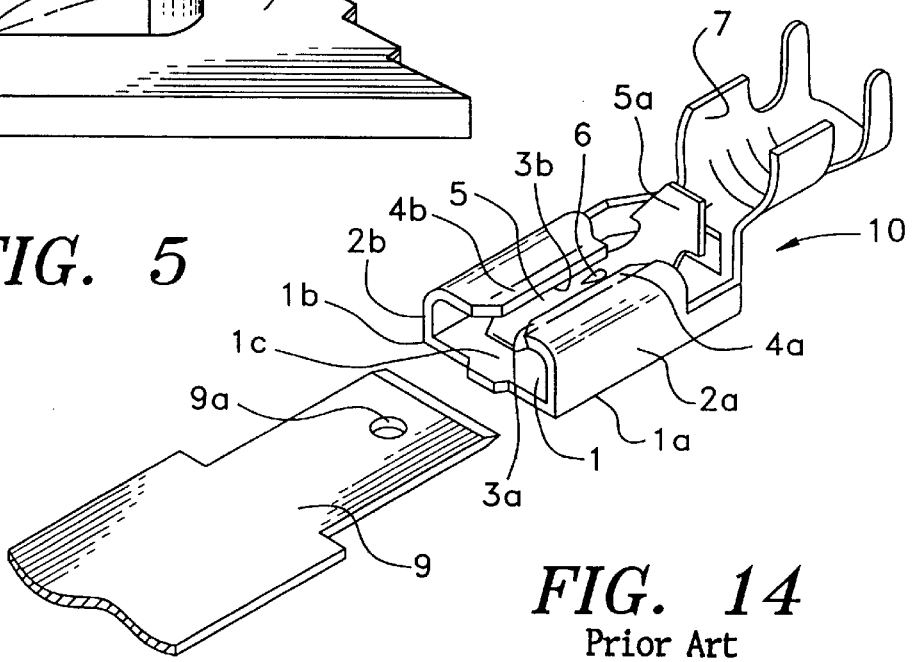
FIG. 14 Prior Art
FIG. 14 is an isometric view of a prior art female terminal.

FIG. 5 is a partial detailed view of the projection portion shown in FIG. 4.

As is shown in FIG. 5, the projection portion 46 is formed, during the punching of the metal sheet, into a shape which is such that a portion of the bottom plate 41 protrudes upward as an inclined surface rising to the right along the direction in which the mating tab terminal is inserted, i. e., in the direction indicated by arrow A.

After the metal sheet has been punched out, as shown in FIGS. 4 and 5, the various parts are subjected to specified deformation working, thus completing a female terminal 100 of the shape shown in FIG. 1. The portion of this deformation working that concerns the anti-overstress function mentioned above will be described below with reference to FIGS. 1, 4 and 5.

The side plate portions 42 are bent inward from both side edges 11*a* and 11*b* of the bottom plate portion 41, thus forming the side plates 12*a* and 12*b*. The free ends of the side plates 12*a* and 12*b* are bent even further inward toward the bottom plate, thus forming the upper contact parts 14*a* and 14*b*. Furthermore, the arm part portions 50 are separated from the side plates 12*a* and 12*b* at both side edges 11*a* and 11*b* of the bottom plate portion 41, and the free ends 21*a* and 21*b* are bent back over the upper contact parts 14*a* and 14*b* in positions located above the upper contact parts 14*a* and 14*b*, so that the resulting arm parts perform an anti-overstress function which prevents deformation of the upper contact parts 14*a* and 14*b*.

In order to insure that the free ends 21*a* and 21*b* of the arm parts 20*a* and 20*b* are bent back over the upper contact parts 14*a* and 14*b*, it is necessary to form the upper contact parts 14*a* and 14*b* so that after the free ends of the side plates 12*a* and 12*b* have been bent inward so that these free ends face the bottom plate, the upper contact parts 14*a* and 14*b* are bent even further inward so that [i] the free ends 21*a* and 21*b* of the arm parts 20*a* and 20*b* reach the positions 22*a* and 22*b* located above the upper contact parts 14*a* and 14*b*, and [ii] the respective parts overlap sufficiently. Furthermore, the protruding portions 23*a* and 23*b* of the free ends 21*a* and 21*b* act to supplement the anti-overstress function by further widening the overlapping portions described above.

Next, a second embodiment of the female terminal of the present invention will be described.

Figure 6:
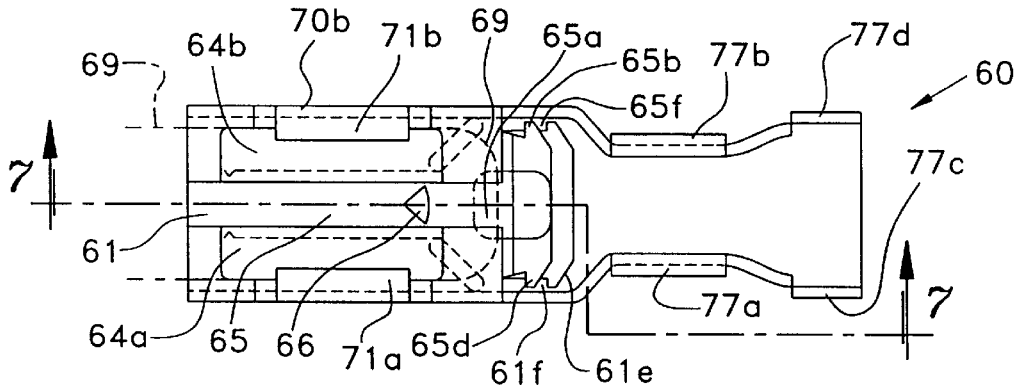
FIG. 6 shows a top view which illustrate a second embodiment of the female terminal of the present invention.
Figure 7:
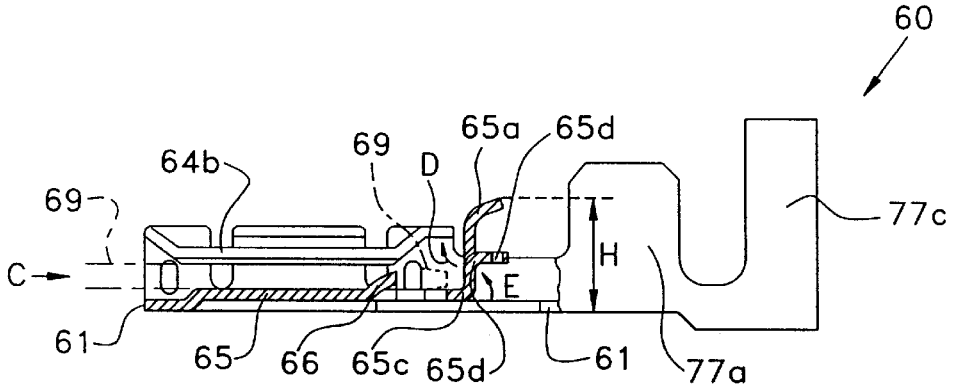
FIG. 7 shows a partial cross sectional view along line 7—7 in FIG. 6.
Figure 8:
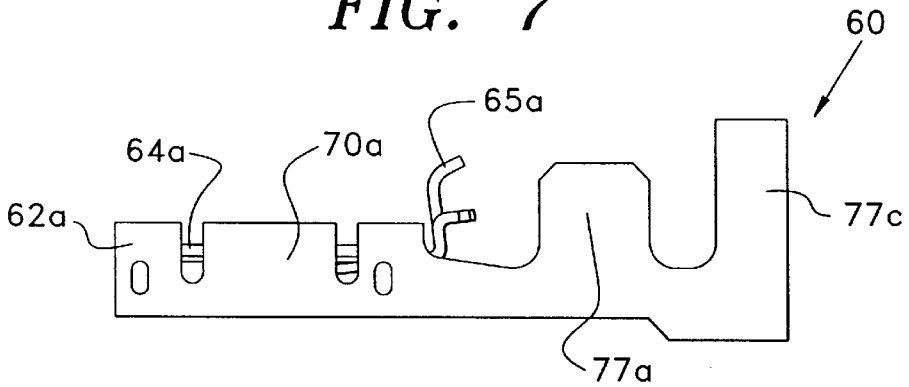
FIG. 8 shows a side view of the female terminal of FIG. 6.
Figure 9:
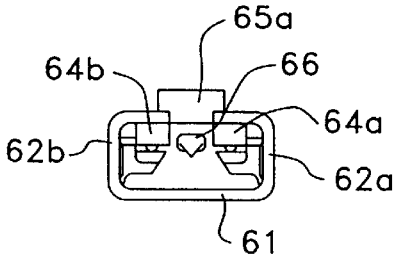
FIG. 9 shows a front view of the female terminal of FIG. 6.

FIGS. 6–9 show a second embodiment of the female terminal of the present invention. FIG. 6 is a plan view, FIG. 7 is a partial sectional view along line 7—7 in FIG. 6, FIG. 8 is a side view of FIG. 6, and FIG. 9 is a side view of FIG. 7 from the tab terminal insertion side, (i. e., from the direction indicated by arrow C).

FIGS. 6 through 9 show a female terminal 60 which is equipped with a bottom plate 61, side plates 62*a* and 62*b*, upper contact parts 64*a* and 64*b*, a lower contact part 65, a projection 66, a pressing part 65*a*, arm parts 70*a* and 70*b*, arm part free ends 71*a* and 71*b*, conductor barrels 77*a* and 77*b*, insulation barrels 77*c* and 77*d* and the like. Furthermore, the broken line 69 indicates the insertion position of the mating tab terminal.

In the female terminal 60 of the second embodiment the present invention, the free ends 71*a* and 71*b* of the arm parts are bent back over the upper contact parts 64*a* and 64*b* in positions located above the upper contact parts 64*a* and 64*b*, so that the free ends 71*a* and 71*b* of the arm parts perform an anti-overstress function with respect to the upper contact parts 64*a* and 64*b*.

In the female terminal 60 of the second embodiment, the pressing part 65*a*, which is formed on the rear end portion of the lower contact part 65, is cut and raised in the direction indicated by arrow D with a first bent portion 65*d* being caused to act as a supporting point, and is then cut and raised in the direction indicated by arrow E with a second bent portion 65*c* being caused to act as a supporting point, so that the cross section of the pressing part 65*a* is formed into a right-angled shape. By thus cutting and raising the pressing part 65*a* in two stages, it is possible to increase the height H of the pressing part 65*a* while curtailing the overall length of the lower contact part 65.

Furthermore, in the female terminal of the second embodiment, projecting parts 65*d* are formed on the rear end portion of the lower contact part 65 by making the shape of the lower contact part portion that is punched out of the bottom plate portion, when the female terminal is punched out of a metal sheet, a T shape as indicated by the outline 61*e* shown in FIG. 6. As a result of the rear end portion of the lower contact part 65 in the vicinity of these projecting parts 65*d* being cut and raised in the direction indicated by arrow E in FIG. 7, the horizontal positions of the projecting parts 65*d* are shifted to the left so that the projecting parts 65*d* and the edges 61*f* of the bottom plate 61 overlap above and below (with a space left in between). Accordingly, even if an unreasonable force is applied to the lower contact part 65 as a result of the tab terminal being inserted from an incorrect insertion direction, the projecting parts 65*d* contact the edges 61*f* of the bottom plate 61 so that an anti-overstress function with respect to the lower contact part 65 is exhibited.

Figure 10:
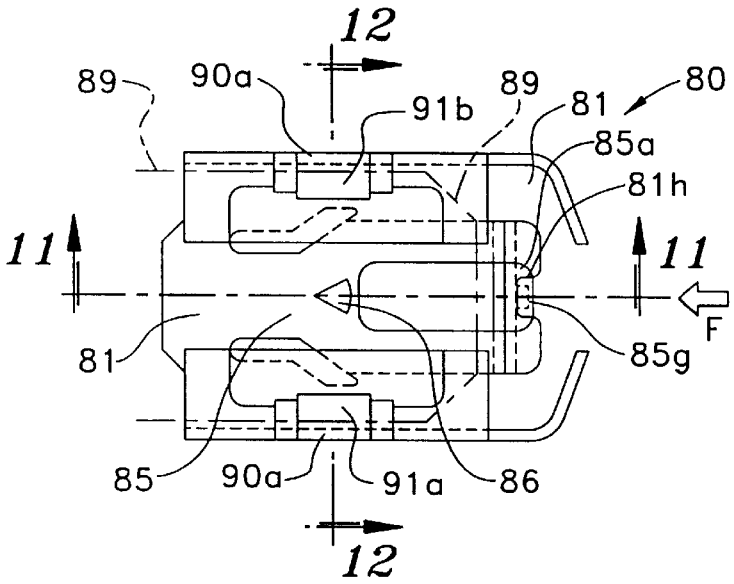
FIG. 10 shows a partial top view which illustrates a third embodiment of the female terminal of the present invention.
Figure 13:
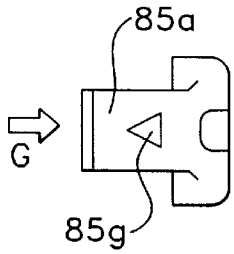
FIG. 13 shows an enlargement of the pressing part of the female terminal shown in FIG. 10.
Figure 11:
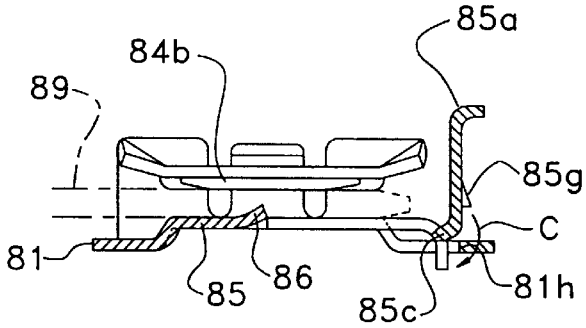
FIG. 11 shows a partial cross sectional view taken along line 11—11 in FIG. 10.
Figure 12:
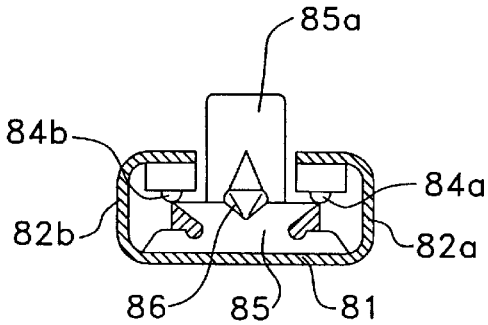
FIG. 12 shows a cross-sectional view of the female terminal of FIG. 10 taken along line 12—12 thereof.

FIGS. 10–13 show explanatory diagrams which illustrate a third embodiment of the female terminal of the present invention. FIG. 10 is a plan view, FIG. 11 is a sectional view along line 11—11 in FIG. 10, FIG. 12 is a sectional view along line 12–12 in FIG. 10, and FIG. 13 is a side view of the pressing part 85*a* in FIG. 10 from the direction indicated by arrow F.

FIGS. 10 through 13 show a female terminal 80 which is equipped with a bottom plate 81, side plates 82*a* and 82*b*, upper contact parts 84*a* and 84*b*, a lower contact part 85, a projection 86, a pressing part 85*a*, arm parts 90*a* and 90*b*, arm part free ends 91*a* and 91*b* and the like. Furthermore, the broken line 89 indicates the insertion position of the mating tab terminal.

In the female terminal 80 of the third embodiment of the present invention, the free ends 91*a* and 91*b* of the arm parts are bent back over the upper contact parts 84*a* and 84*b* in positions located above the upper contact parts 84*a* and 84*b*, so that the free ends 91*a* and 91*b* of the arm parts perform an anti-overstress function with respect to the upper contact parts 84*a* and 84*b*.

In the female terminal of the third embodiment, the pressing part 85*a* formed on the rear end portion of the lower contact part 85 is formed as follows: after the rear end portion of the lower contact part 85 is bent in the direction indicated by arrow C with a bent portion 85*c* at the rear end of the lower contact part 85 being used as a supporting point, the cross-sectional shape of the pressing part 85*a* is formed into an S shape as shown in FIG. 11, and a second projection 85*g* is formed on the vertical portion of the pressing part 85*a*. This second projection 85*g* is positioned directly above a projecting part 81*h* formed in the punched-out portion of the rear end portion of the bottom plate 81. Accordingly, in cases where the tab terminal is inserted from an incorrect insertion direction, the second projection 85*g* contacts the projecting part 81*h*, so that deformation of the lower contact part 85 is prevented. Thus, an anti-overstress function is obtained.

Furthermore, in the respective embodiments described above, examples of terminals were described which were equipped with a pressing art formed by a process in which a portion of the lower contact part was cut and raised upward with the rear end portion of the lower contact part being used as a supporting point. However, the present invention is not limited to female terminals equipped with a pressing part of the type; it would also be possible to construct a female terminal equipped with a pressing part formed by extending the lower contact part rearward as in the conventional example described above. However, from the standpoint of reducing the overall size of the female terminal, a terminal type in which the pressing part is formed by cutting and raising a portion of the lower contact part as in the respective working configurations described above is more desirable.

In the female terminal of the present invention, as was described above, arm parts which are separated from the side plates are bent back over upper contact parts which are formed by bending the free ends of the side plates inward so that these free ends face the bottom plate. Accordingly, deformation of the female terminal can be prevented even if an abnormal force is applied to the upper contact parts when a tab terminal is inserted.

Furthermore, the pressing part disposed on the rear end portion of the lower contact part is formed by a process in which a portion of the lower contact part is cut and raised upward; accordingly, the overall length of the female terminal is shortened, so that a compact female terminal can be obtained.

I claim:

1. A female electrical terminal for electrical connection to a mating tab terminal, comprising a base plate having side plates extending upwardly from the base plate;

upper contact parts located at ends of the side plates extending over the base plate and substantially parallel to the base plate;

a lower contact part extending rearwardly from a forward part of the base plate and having a projection thereon for engaging a hole in the mating tab terminal; and arm parts extending upwardly from the base plate with free ends of the arm parts being disposed above the upper contact parts to provide overstress protection to the upper contact parts.

2. The female electrical terminal of claim 1, wherein the arm parts are part of the side plates.

3. The female electrical terminal of claim 1, wherein protruding portions are provided at the free ends of the arm parts.

4. The female electrical terminal of claim 1, wherein the upper contact parts have beads extending inwardly for electrical connection with the mating tab terminal.

5. The female electrical terminal of claim 1, wherein the lower contact part has a pressing part to release the projection from engagement with the hole of the mating tab terminal.

6. The female electrical terminal of claim 5, wherein the lower contact part has a cantilever section on which the projection is located and the pressing part extends upwardly from the cantilever section and is offset therefrom.

* * * * *